United States Patent [19]

Lienhard

[11] Patent Number: 4,573,294

[45] Date of Patent: Mar. 4, 1986

[54] FRAMEWORK FOR BUILDING CONSTRUCTION

[75] Inventor: Robert W. Lienhard, Pittsburgh, Pa.

[73] Assignee: Swiss Fabricating, Inc., Pittsburgh, Pa.

[21] Appl. No.: 463,522

[22] Filed: Feb. 3, 1983

[51] Int. Cl.[4] ..... E04B 7/02

[52] U.S. Cl. ..... 52/93; 52/96

[58] Field of Search ..... 52/93, 91, 637, 638, 52/94, 96, 300; 403/49, 364; 182/178, 179

[56] References Cited

U.S. PATENT DOCUMENTS 2,108,065 2/1938 Kotrbaty ..... 52/285

2,111,634 3/1938 Kotrbaty ..... 52/300

3,777,426 12/1973 Weiner ..... 52/92

*Primary Examiner*—James L. Ridgill, Jr.

*Attorney, Agent, or Firm*—Robert D. Yeager; Christine R. Ethridge

[57] ABSTRACT

A framework for use in constructing a building that is capable of rapid assembly and disassembly is disclosed. The framework includes a plurality of spaced column members joined at their upper ends by beam members, the joinder being effected by means of aligned pin receiving means on the column and beam secured with a pin. Means are provided within the framework to receive, without the need for fasteners, wall panel members and roof panel members.

1 Claim, 16 Drawing Figures

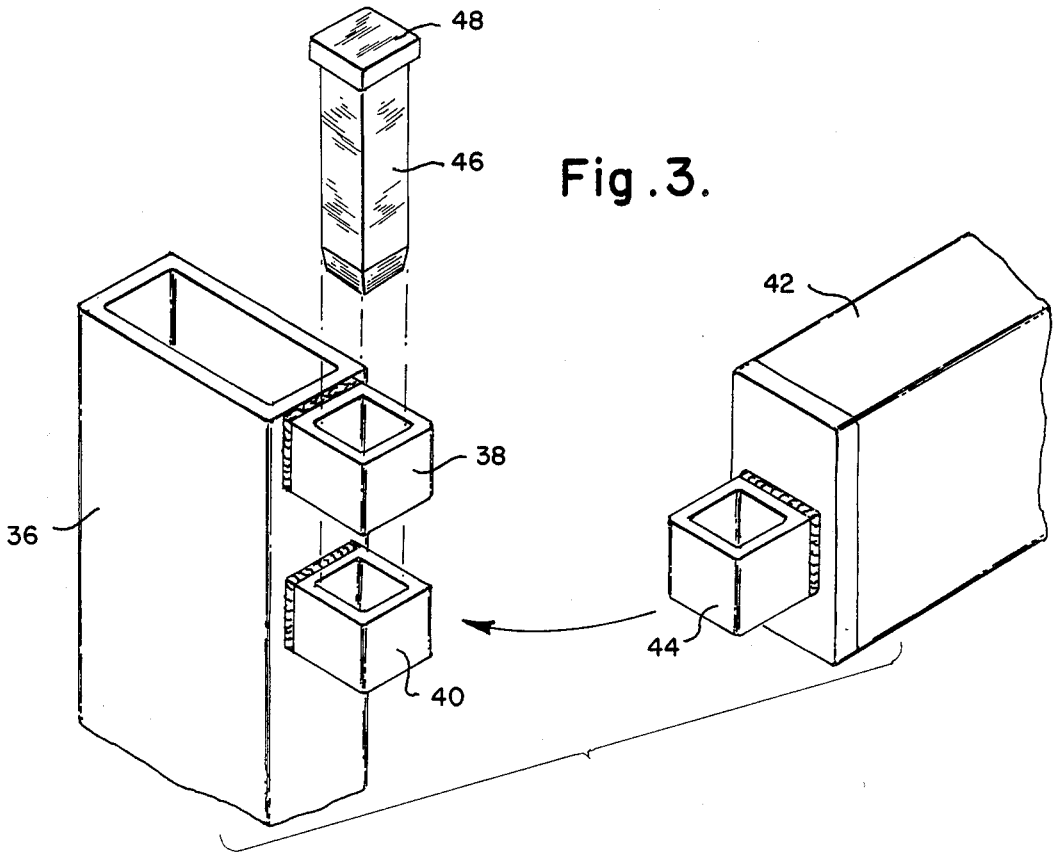
Fig. 3.
Fig. 4.
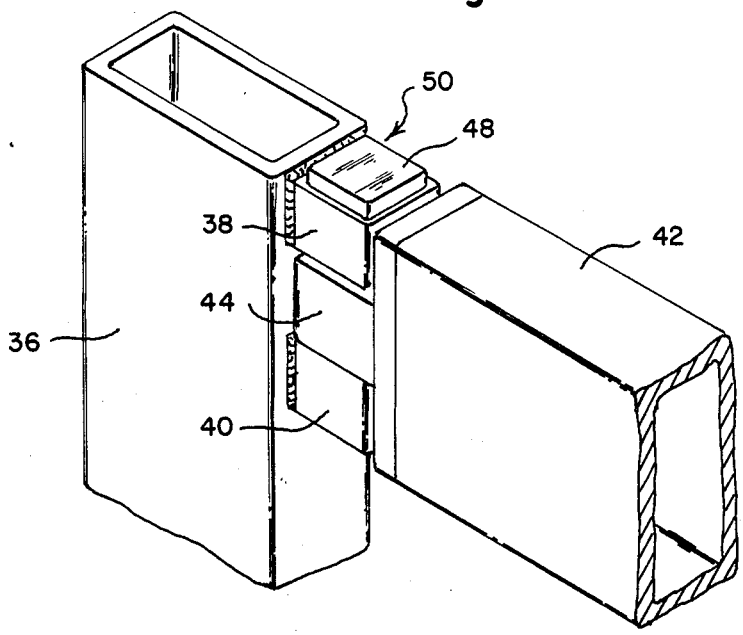

FRAMEWORK FOR BUILDING CONSTRUCTION

BACKGROUND OF THE INVENTION

1. Field of the Invention

This invention relates to a framework for use in constructing a building, particularly where rapid erection and disassembly is desired.

2. Description of the Prior Art

With the increased emphasis on the need for mobility in the conduct of many industrial and military operations, there has arisen a corresponding need for methods and materials that permit the rapid erection and disassembly of buildings required to support such operations. Examples of such buildings are living quarters for workers and offices or other administrative structures.

A similar need existed during the World War II era and that need was adequately met by the well-known "Quonset Hut" type structure. This type of structure remains useful in some applications but the erection of a "Quonset Hut" building involves the use of large quantities of fasteners and thus is time consuming. This use of fasteners also reduces the motivation to disassemble the structure and move it to a new location.

Accordingly, there exists a need for a prefabricated building structure that is capable of rapid erection and disassembly by reason of the minimal use of fasteners.

SUMMARY OF THE INVENTION

The present invention provides a framework for use in constructing a building comprising: a plurality of spaced column members; pin receiving means attached at the upper end of each side of each of the column members facing an adjacent column; beam members extending between adjacent column members, each of said beam members having attached at each end a pin receiving means adapted to register with the pin receiving means on said facing column member; a pin member extending through the registered pin receiving means of each column member and beam member at their point of confrontation; means mounted at the top and bottom of each pair of column members intended to be spanned by a wall for snugly receiving vertically arranged wall panel members; and means mounted on each beam member intended to form the perimeter of said building for snugly receiving roof panel members.

The wall panel and roof panel members intended to be received by the framework of the present invention may be of well-known construction such as a sandwich construction consisting of a weather resistant portion, an insulating portion and a decorative portion. These wall and roof panels are received and held within the framework of the present invention without the use of fasteners of any kind. In a preferred embodiment of the present invention, fasteners are needed only to secure roof panels to the framework in the vicinity of a ridge beam.

In the use of the framework of the present invention, it is necessary only to anchor the bottom ends of the column members to a suitable base such as a concrete slab; thereafter erection of the framework and insertion of the wall and roof panel members proceed extremely rapidly. Conversely, disassembly of a building so constructed also may be quickly and conveniently accomplished.

BRIEF DESCRIPTION OF THE DRAWINGS

For a better understanding of the invention, reference may be had to the preferred embodiment exemplary of the invention as shown in the accompanying drawings in which:

FIG. 3 is a fragmentary, exploded, isometric view of the preferred manner for joining beams and columns in the present invention, the beam member shown being rotated 90°;

FIG. 4 is a fragmentary, isometric view of the parts shown in FIG. 3 in a joined condition;

DESCRIPTION OF THE PREFERRED EMBODIMENTS

Figure 1:
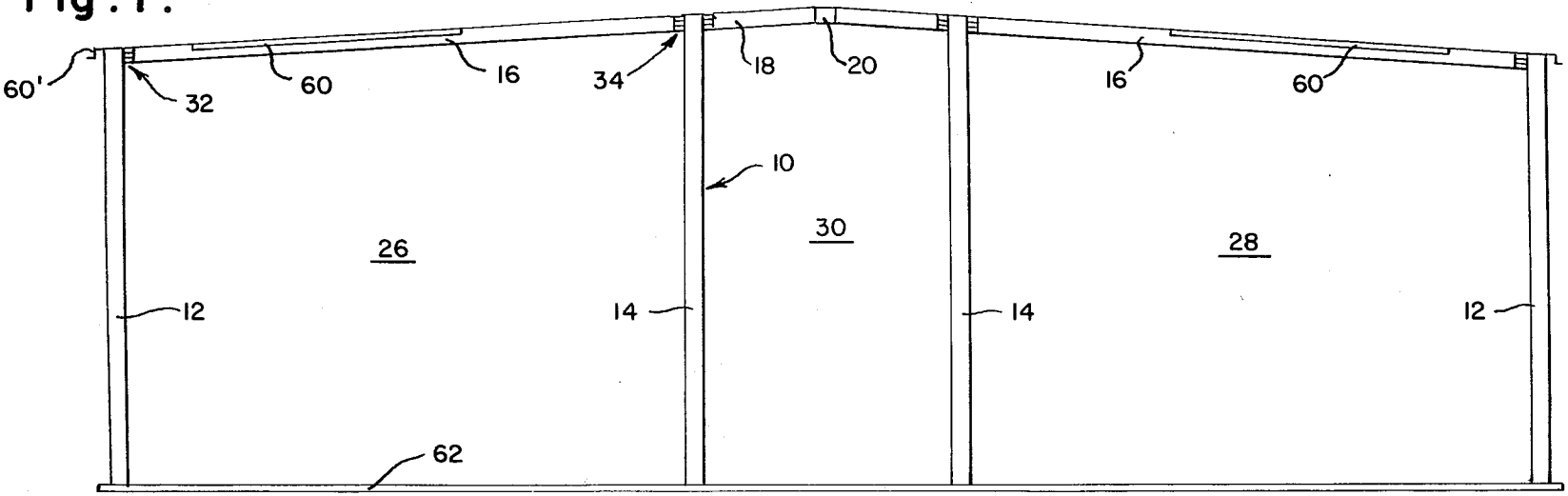
FIG. 1 is a front elevational view of a framework for a building structure.
Figure 2:
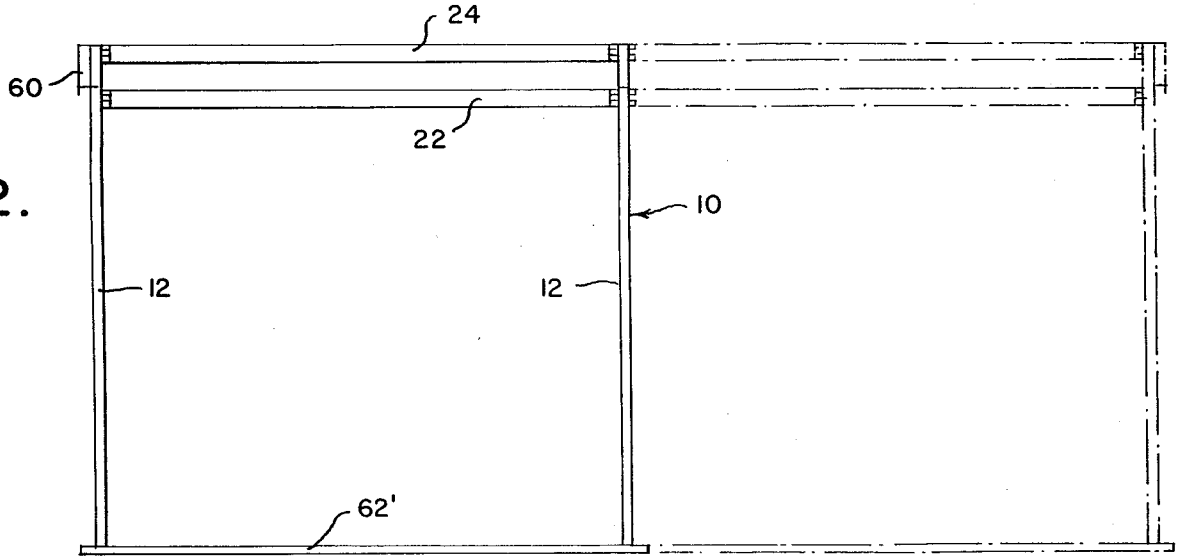
FIG. 2 is a side elevational view viewed from the right end of FIG. 1 with the expansion capability of the framework indicated in chain lines.

Referring to the drawings, particularly to FIGS. 1 and 2, there is shown a framework, generally designated by the reference numeral 10, embodying the present invention. The framework 10 includes spaced upright corner column members 12 (only two of which are shown in FIGS. 1 and 2) and spaced, interior column members 14. Column members 12 and 14 may be anchored to a base in a variety of ways, several of which are described hereinafter. Framework 10 also includes longitudinally extending beam or rafter members 16 and 18 and, in the embodiment shown in the drawings, a ridge beam 20. Still further, framework 10 includes transversely extending beam or rafter members 22 and 24 (see FIG. 2).

Framework 10 is intended to be employed in the construction of a building that is capable of rapid erection and disassembly. The configuration of the building may take a variety of forms; the particular form shown in FIGS. 1 and 2 is one having a ridge beam 20 sloping away gently toward the sides of the building. The interior compartmentalization of the building formed by framework 10 also may take a variety of forms including large open bays such as bays 26 and 28 shown in FIG. 1 with a central corridor 30. As shown by chainline in FIG. 2, framework 10 may be extended transversely to form a building of the desired depth.

A central feature of the present invention is the interlocking structure between columns and beams that affords the rapid assembly and disassembly advantage of the present invention; more specifically, this interlocking structure is formed without the need for conventional fasteners such as bolts, rivets, weld, etc. In the description of this interlocking structure that follows, reference will be made to the interlocking structure present in a corner column designated in FIG. 1 by the reference numeral 32 and in an interior column designated by the reference numeral 34. As will be appreciated by those skilled in the art, these corner and interior column interlocking structures are repeatable throughout framework 10 so that column spacing and location within a particular building may be varied as desired.

Before proceeding to a detailed description of the interlocking structures present at 32 and 34, it will be convenient to describe a preferred means for joining a beam member and a column member in accordance with the present invention; for this purpose, we refer to FIGS. 3 and 4. Column member 36 has attached at its upper end a pair of spaced, aligned sockets 38 and 40. Sockets 38 and 40 are attached, preferably by weldment, to column 36 on the side to which beam member 42 is to be joined. Beam member 42 has attached at the end to be joined a socket 44 which corresponds in configuration to sockets 38, 40; again the preferred means of attachment is by weldment. When socket 44 of beam 42 is moved into position between spaced sockets 38 and 40 of column 36, the openings of sockets 38, 44 and 40 are aligned to receive a locking pin 46 which is configured to conform to the configuration of the openings of sockets 38, 44 and 40. Locking pin 46 has an enlargement 48 formed at its upper end to retain locking pin 46 in the aligned openings. The interlocking structure just described with respect to FIGS. 3 and 4 will be referred to generally hereinbelow as interlocking structure 50 (see FIG. 4).

Figure 7:
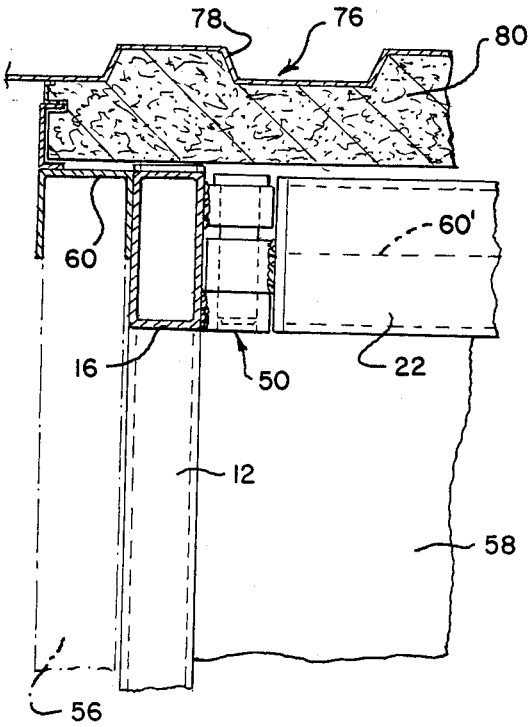
FIG. 7 is a section taken along the line VII—VII of FIG. 6.
Figure 6:
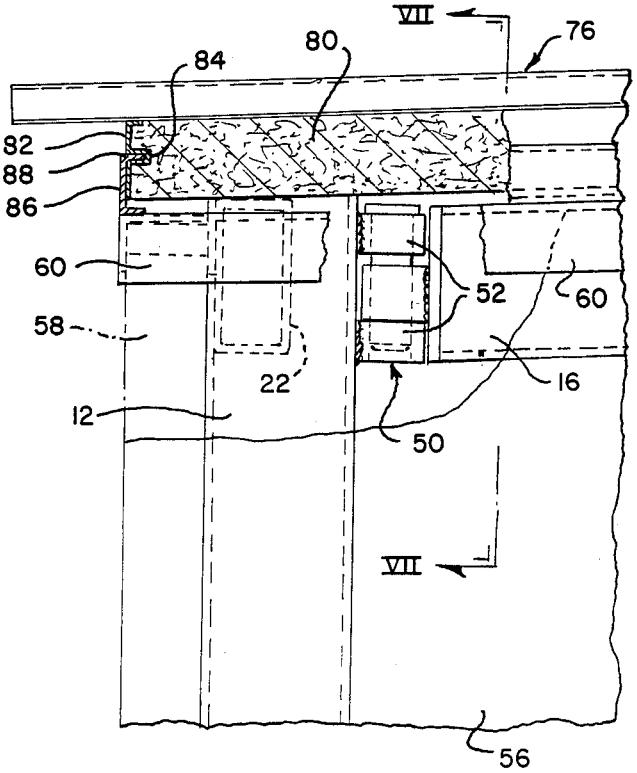
FIG. 6 is a fragmentary view, partly in section, of the upper left corner of the framework shown in FIG. 1, having roof and wall panel members installed.
Figure 5:
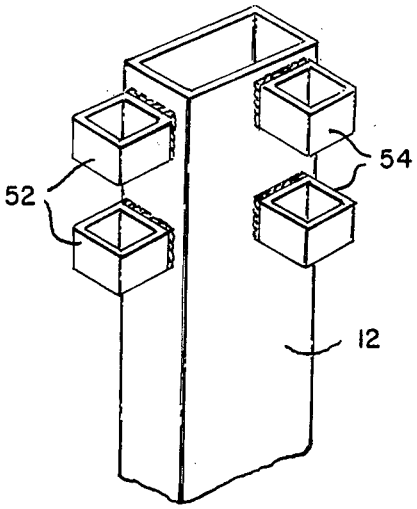
FIG. 5 is a fragmentary, isometric view of the top portion of a corner column employed in the present invention.
Figure 8:
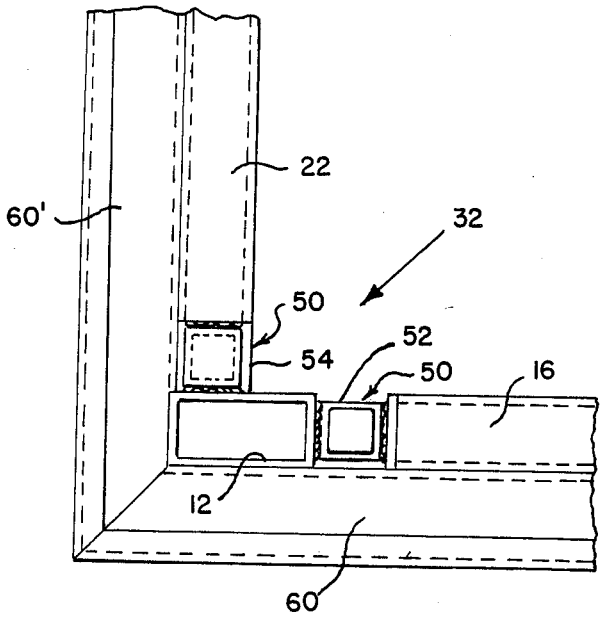
FIG. 8 is a fragmentary, top plan view of FIG. 6 with the roof panel removed.
Figure 10:
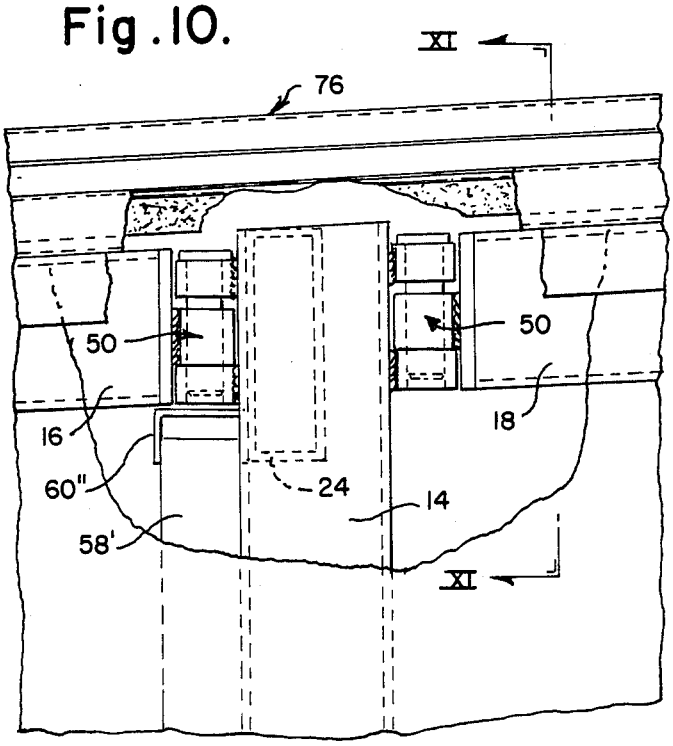
FIG. 10 is a fragmentary view, partly in section, of an interior column having wall panels and a roof panel installed.

We will next describe in detail the structure present at a corner column 12, specifically, the structure present at 32 (see FIG. 1) by reference to FIGS. 5–8. As shown in FIG. 5, corner column 12 is fitted at its upper end with pairs of spaced sockets 52, 54 on the sides of column 12 intended to be connected to beam members. As shown in FIGS. 6–8, longitudinally extending beam member 16 is connected to column 12 through interlocking structure 50. Correspondingly, transversely extending beam 22 is connected to column 12 by an interlocking structure 50. As shown specifically in FIG. 8, the interlocking structure of the transverse and longitudinal beams with column 12 form the corner structure 32 of framework 10.

A further advantageous feature of the present invention is the provision on framework 10 of means for receiving wall panels without a requirement for conventional fasteners. FIGS. 6–8 illustrates the utilization of such means for the installation of exterior walls generally designated by the reference numerals 56, 58; wall 56 being a longitudinally extending front wall and wall 58 being a transversely extending side wall. As will be appreciated by persons skilled in the art, walls 56 and 58 may be suitably constructed of composite materials to form a sandwich construction to meet the needs of the particular building and may be formed in panels of convenient dimensions.

In particular, the means for securing longitudinally extending front wall 56 at its upper edge includes an inverted channel member 60 attached at one leg to the outboard side of beam member 16 at its upper edge (see FIG. 7). The flat surface portion of the base of channel member 60 forms a continuous surface with the top surface of beam member 16. Channel member 60 preferably extends continuously along the length of beam member 16.

The means for securing the lower edge of longitudinally extending wall 56 is best illustrated in FIGS. 13–16 and more generally in FIGS. 1 and 2. The lower wall panel securing means includes an upright channel member 62 supported by a base structure (not shown) and attached to column member 12 by means described hereinafter. Channel member 62 is vertically aligned with channel member 60 described above. The individual panels comprising longitudinally extending front wall 56 are installed by first inserting them at their upper edges within channel member 60. The lower edge of the panels are then moved downwardly and lowered into channel member 62. As will be appreciated by those skilled in the art, the recess within channel member 60 is, therefore, deeper than the recess formed within channel member 62 to permit the installation just described. Further, the width of the recesses in channel members 60, 62 are dimensioned in accordance with the desired thickness of the panels comprising wall 56 to provide a snug fit.

Transversely extending exterior side wall 58 is installed and secured by identical means to the means just described with respect to longitudinally extending front wall 56. The particular structural items comprising these means bear like reference numerals with a prime affixed.

Figure 11:
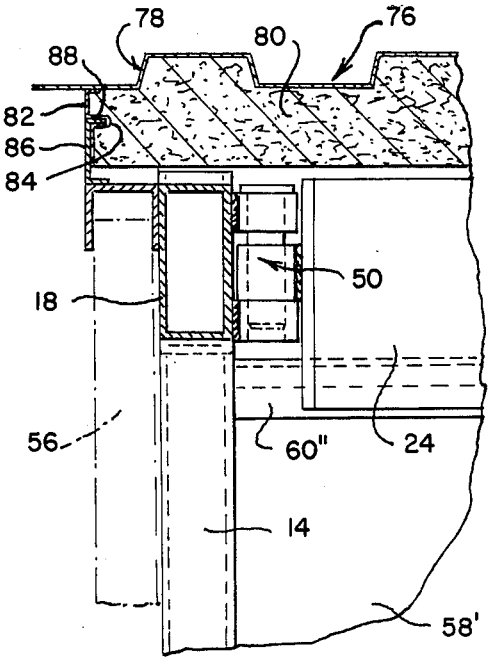
FIG. 11 is a sectional view taken along the line XI—XI of FIG. 10.
Figure 12:
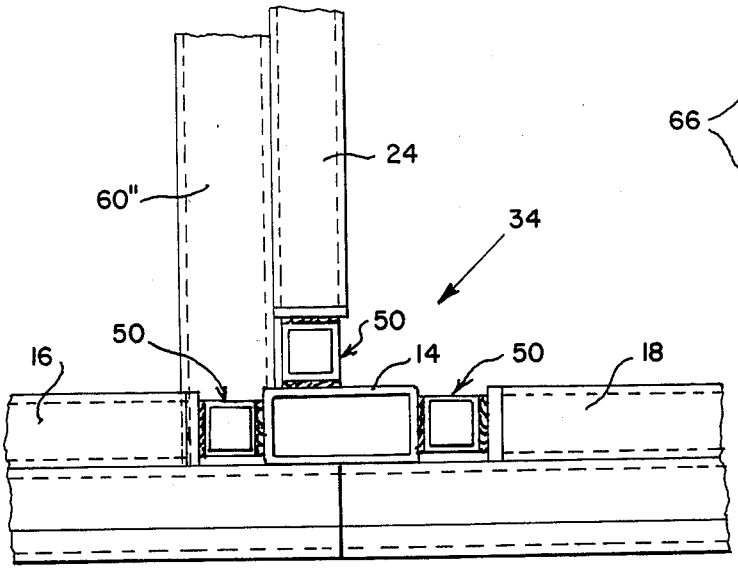
FIG. 12 is a fragmentary, top plan view of FIG. 10 with the roof panel removed.
Figure 9:
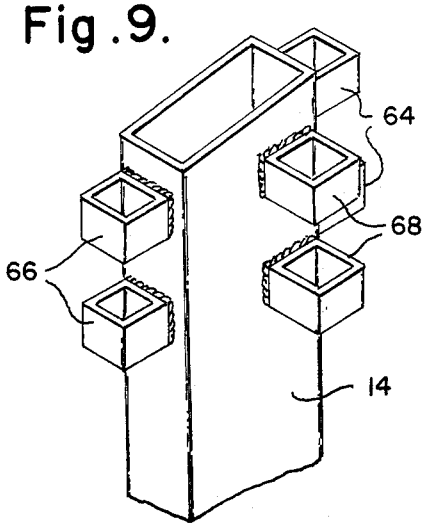
FIG. 9 is a fragmentary, isometric view of an interior column employed in the present invention.
Figure 14:
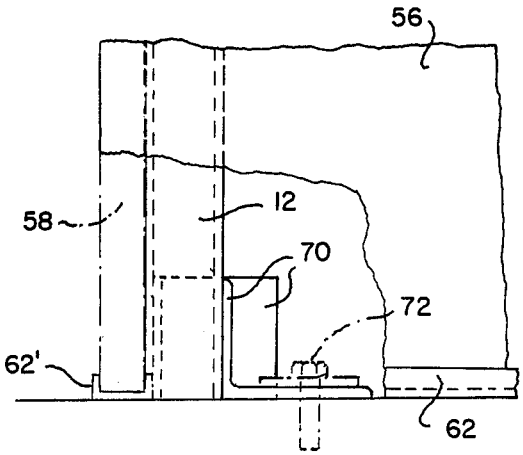
FIG. 14 is a fragmentary, side elevational view of FIG. 13 with a wall panel member installed.
Figure 15:
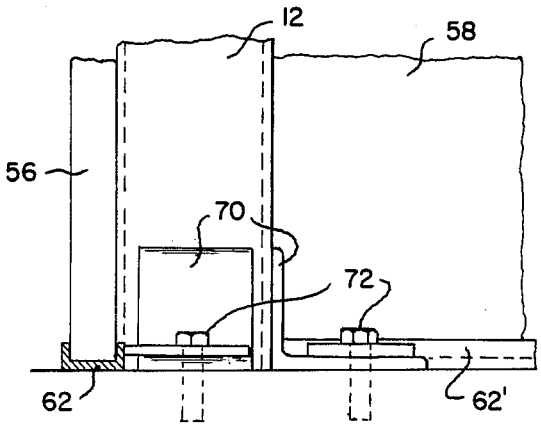
FIG. 15 is a view of FIG. 14 taken from the right.
Figure 16:
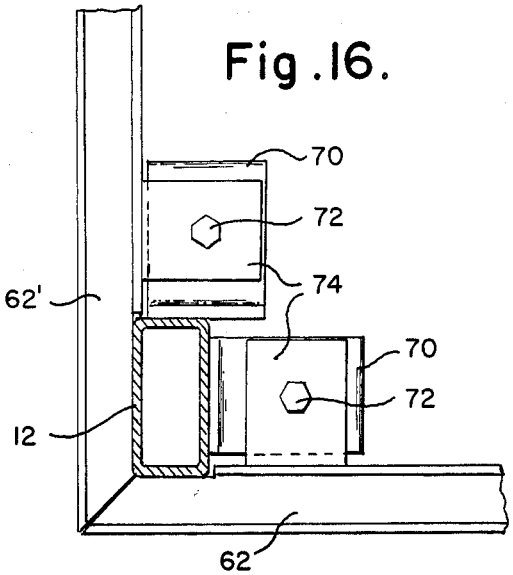
FIG. 16 is a top fragmentary plan view, partly in section, of FIG. 14.
Figure 13:
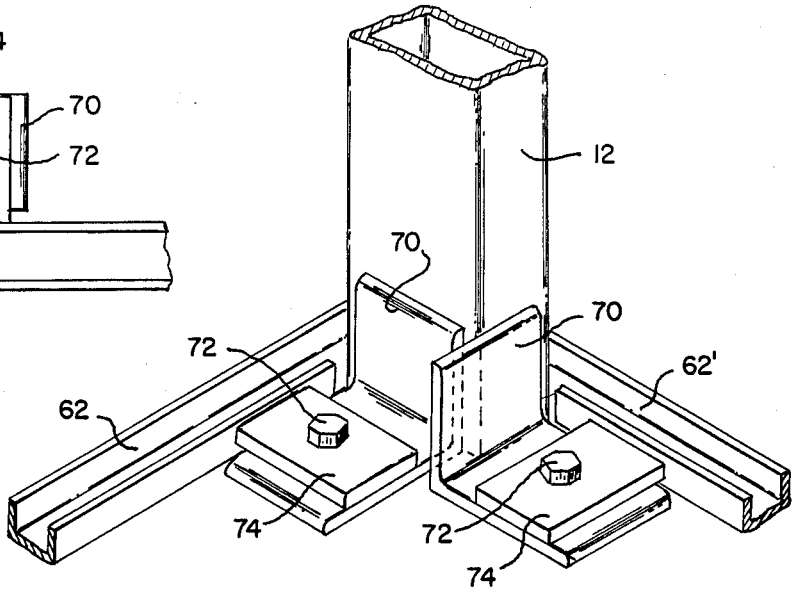
FIG. 13 is a fragmentary, isometric view of a preferred means of anchoring a corner column in the present invention.

By reference to FIGS. 9–12, joint 34 formed at the top of an interior column 14 will now be described. As shown in FIG. 9, required pairs of sockets 64, 66 and 68 are attached at the top of column 14 at the sides of the column intended to receive beam members. As shown in FIG. 11, transverse beam 24 is connected to column 14 by means of an interlocking structure 50. Longitudinally extending beams 16 and 18 are similarly connected to column 14 by interlocking structures 50.

Transversely extending interior wall 58' is installed and secured in the manner described above with respect to transversely extending exterior side wall 58. That is, the upper edge of each interior wall panel comprising interior wall 58' is inserted into inverted channel member 60''; then the wall panel is lowered into a channel member (not shown but similar to channel member 62) running along the feet of the transversely extending interior columns.

As alluded to above, the lower ends of columns 12, 14 may be suitably anchored to a base by a variety of means. One such means is shown in FIGS. 13–16. There is shown anchor clips 70 welded at their upright legs to column 12 and secured at their base legs by means of bolts 72. Horizontally extending tabs 74 may be welded to the upright channel members 62, 62' and interposed between the base legs of clips 70 and the head of bolts 72 as retention means for channel members 62, 62'.

The roof 76 of a building formed by the use of the framework 10 of the present invention may be constructed by any well-known means. A particularly advantageous form of roof construction is illustrated in the drawings and employs composite roof panels consisting of a corrugated metal top surface 78 and an insulating core portion 80. As shown in the drawings, more particularly in FIGS. 6, 7 and 11, insulating core portion 80 includes at its perimeter a clip 82 welded to the lower surface of the corrugated member 78 and extending downwardly along the entire thickness of core portion 80. Clip 82 includes an inwardly extending recess 84. Inwardly facing channel member 86 is welded to the outer top surface portions of inverted channel members 60, 60' and is dimensioned so that its free leg 88 engages recess 84 of insulating core portion 80. Roof 76 is thus supported on framework 10 and is anchored at its perimeter by means of the clip and channel arrangement just described. It may be necessary in forming roof 76 to use conventional means of securement elsewhere in the central portion of roof 76 such as, for example, in the transversely extending seam of ridge beam 20.

What is claimed is:

1. A framework capable of rapid erection and disassembly for use in constructing a building comprising:

a plurality of spaced column members;

at least one socket member attached at the upper end on each side of each of said column members facing an adjacent column member, said socket member defining an axial opening;

beam members extending between adjacent column members, each of said beam members having attached at each end a socket member defining an axial opening and proportioned to releasably register with said socket member on said facing column member in alignment therewith so that said openings of such registered socket members define a pin receiving means;

a pin member releasably extendable through said pin receiving means to releasably interlock said beam member and said facing column member;

channel members so mounted at the top and bottom of each pair of column members intended to be spanned by a wall that such top and bottom mounted channel members project exteriorly from said pair of column members in vertical alignment with each other, said channel members having opposing recesses for snugly and releasably receiving vertically arranged wall panel members along the outboard side of said pair of column members; and inwardly facing channel members mounted on said channel members at the top of each pair of column members intended to form the perimeter of said building, each said inwardly facing channel member having a free leg; and clip means for releasably engaging said free leg for connecting roof panel members to said framework.

* * * * *